United States Patent [19]

Zemel

[11] Patent Number: 4,899,058

[45] Date of Patent: Feb. 6, 1990

[54] MICROARCHITECTURAL DEEP WELL SURFACES

[75] Inventor: Jay N. Zemel, Jenkintown, Pa.

[73] Assignee: Trustees of the University of Pennsylvania, Philadelphia, Pa.

[21] Appl. No.: 160,779

[22] Filed: Feb. 26, 1988

[51] Int. Cl.[4] ..... G21K 1/00

[52] U.S. Cl. ..... 250/492.1; 250/493.1; 250/494.1; 250/503.1; 250/505.1

[58] Field of Search ..... 250/492.1, 493.1, 494.1, 250/503.1, 505.1

[56] References Cited

PUBLICATIONS

Hesketh et al., *Nature, vol. 324, No. 6097, Dec. 11, 1986, pp. 549–551.*

Challener et al., *Infrared Physics,* vol. 20, No. 4, Jul. 1980, pp. 215–222.

*Primary Examiner*—Jack I. Berman

*Attorney, Agent, or Firm*—Woodcock Washburn Kurtz Mackiewicz & Norris

[57] ABSTRACT

Microachitectured, deep well surfaces have been disclosed. Such surfaces geometrically generate high energy standing waves within the deep wells when irradiated or heated. The high energy standing waves are quantum states. Uses for the microarchitectured, deep well surfaces have also been disclosed and include, but are not limited, to spectroscopy, photocatalysts and energy tuners.

2 Claims, 5 Drawing Sheets

MICROARCHITECTURAL DEEP WELL SURFACES

FIELD OF THE INVENTION

This invention provides novel microarchitectural and micromachined surfaces and gratings wherein the depth of the grating wells is comparable to or greater than the repeat distance of the grating. This invention also provides novel applications of microarchitectural and micromachined surfaces.

BACKGROUND OF THE INVENTION

A diffraction grating is any arrangement which is equivalent in its action to a number of parallel equi-distant slits of the same width. By studying the intensity patterns produced by electro-magnetic radiation which is incident upon a diffraction grating, the study of various spectra is possible. For this reason the diffraction grating is an extremely powerful tool for divining information from radiant sources.

Generally, in diffraction gratings, the widths of the individual slits are small compared to the wavelengths of electromagnetic radiation which impinge upon the grating. Therefore, when electromagnetic radiation is incident upon the grating, characteristic diffraction patterns are created and may be viewed such as on a screen at some distance from the grating. These diffraction patterns are spectral lines that carry unique information about the source. The diffraction pattern is a series of lines which are a function of the width, d, of the diffraction grating, the wavelength of the light, $\lambda$, the angle of incidence of the light to the diffraction grating, $\theta$, and m, the number of orders present in the pattern.

This yields the standard grating equation:

$$d \sin \theta = m\lambda$$

which may be generalized to:

$$d(\sin i + \sin \theta) = m\lambda$$

wherein i is the angle of incidence of the radiation and $\theta$ is the transmittance angle between the normal and the path of the rays.

While diffraction gratings are very useful in spectroscopy they do not function to produce high order energy fluxes in the interior of the gratings themselves. Matter at temperatures above absolute zero emits electromagnetic radiation over a broad wavelength spectrum. The emitted energy depends not only on the temperature but also upon the material properties, surface conditions, and direction of emission. It is well known that the maximum emissive power is that of a blackbody. The emissive power per unit surface area, $E_b$, is given by the Stefan-Boltzman Law, while the spectral emissive power, $E_{b,\lambda}$, for a blackbody is given by Plancks' Law, provided the wavelength is much less than the characteristic linear dimension of the blackbody. Furthermore, the directional emissive properties of a blackbody obey Lambert's Law such that if a radiometer was moved over the surface of a hemisphere of radius r above a blackbody aperture of elemental area da, the measured radiation intensity would vary as the cosine of the polar angle. Lambert's Law yields the following equation for directional blackbody intensity:

$$I_b = \frac{E_b \, da \cos\theta}{\pi r^2}$$

The spectral blackbody intensity is given by:

$$I_{b,\lambda} = \frac{E_{b,\lambda} da \cos\theta}{\pi r^2}$$

For many materials the actual directional intensity, I, is obtained by multiplying $I_b$ the directional emissivity yielding:

$$I = \epsilon_{\theta\phi} I_b$$

wherein $E_{\bar{O}\phi}$ is the directional emissivity.

The directional spectral intensity for a smooth surface is obtained in the same manner by using the directional spectral emissivity $\epsilon_{\lambda\theta\phi}$;

$$I_\lambda = \epsilon_{\lambda\theta\phi} I_{b,\lambda}$$

Hence, this emissivity is the ratio of the actual emitted intensity to that of a blackbody of the same temperature for the same wavelength and the same direction:

$$\epsilon_{\lambda\theta\phi} = \frac{I_\lambda}{I_{b,\lambda}}$$

The directional spectral polarized emissivity for the s-polarized electromagnetic field is:

$$\epsilon_{\lambda\theta\phi s} = \frac{I_s}{I_{b,\lambda,s}}$$

For the polarized electric field the p is substituted for s. The p-polarized electric field is parallel to the plane containing the surface normal and direction of observation. The s-polarized field is perpendicular to the surface normal and direction of observation. The term emittance is used instead of emissivity for surfaces which are not pure materials and/or not smooth.

The study of electromagnetic absorption on diffraction gratings has been studied classically. Examples of such studies may be found in, R. W. Wood, "On a Remarkable Case of Uneven Distribution of Light in the Diffraction Grating Spectrum", Philos. Mag., 4, 396–402 (1902); and C. Harvey Palmer, "Diffraction Grating Anomalies. II. Coarse Gratings", J. Opt. Soc. Am., 46 (1), 50–53 (1956). Prior studies deal with shallow gratings having aspect ratios of less than unity. The aspect ratio is the grating depth, H, divided by the grating repeat distance, $\Lambda$. The interaction of a p-polarized electromagnetic wave with a diffraction grating gives rise to rapid bright and dark variations in the reflected spectrum which is termed as a "singular anomaly". Singular anomalies are associated with resonant absorption processes on the grating. Furthermore, they correspond with the onset or disappearance of particular spectral diffraction orders. The singular anomalies are known as Rayleigh wavelengths, $\lambda_R$, and depend on the polar angle and grating repeat distance $\Lambda$ as:

$$\lambda_R = {}_m\Lambda[\sin\theta \pm 1]$$

where m is an integer. Studies with diffraction gratings having depths greater than the wavelength produced anomalies in the s-polarized light not predicted by earlier theories which assumed H was much greater than the wavelength.

The calculations and measurements for regular surface structures have generally assumed that the radiant wavelength is very small compared to the physical dimension, S, of the surface structure. In this regime, a geometric optical interpretation may be applied. Also, there is no spectral dependence, other than that which arises from the particular material. Comprehensive reviews of measurements with "V-shaped" and other differently shaped grooves are given in the literature, for example, P. Demont, M. Hvetz-Aubert, H. Trann-'guyen, "Experiment on Theoretical Studies of the Influence of Surface Conditions on Radiative Properties of Opaque Materials", Int. J. Thermophysics 3, 335–364 (1982).

Furthermore, the geometrical and mathematical theories which explain the s and p-polarized radiant emittances from gratings do not explain the existence of large maxima in s and p-polarized emittance when the repeat distance is comparable to or only slightly less than the depth.

While much is known about diffraction gratings and blackbody radiation, it has not been known to achieve high flux densities internal to certain types of gratings. In particular, the unique properties of microarchitectural deep well surfaces has not been known heretofore. A fortiori, the use of such surfaces has not been known previously.

SUMMARY OF THE INVENTION

It has now been found that microarchitectured, deep well surfaces will generate quantum states within the wells of the surface by virtue of their geometry. These quantum states are manifested by high energy standing waves. These high energy standing waves, in preferred embodiments, are generated by continually radiating the microarchitectured surface with electromagnetic radiation. It has also been discovered that thermal heating of the microarchitectured surface can produce quantum states.

In preferred embodiments, the microarchitectured surface is comprised of a silicon substrate on which a number of deep wells are etched on the surface such as with a photolithographic technique. In preferred embodiments, the wells have a depth greater than or equal to about 45 micrometers and lengths which are substantially less than the depths, preferably less than about 200% of the depths. In other preferred embodiments the wells have a uniform repeat distance preferably on the order of said depths. In a preferred embodiments, geometrical quantum states are stimulated in the depths of the wells by illuminating the surface with coherent radiation. In other preferred embodiments, quantum states are stimulated by heating the surface, such as to a temperature of greater than about 400° C.

It is an object of the present invention to provide microarchitectured surfaces having a plurality of wells etched on the surface, said wells having lengths substantially less than their depths.

It is another object of this invention to provide a microarchitectured surface with deep wells wherein high energy standing waves are generated in the deep wells of said surface.

It is another object of this invention to provide a method of spectroscopy utilizing a deep well, microarchitectured surface wherein high energy standing waves are excited in the deep wells of the surface.

It is yet another object of this invention to provide a solid photocatalyst comprising a microarchitectured surface wherein high energy standing waves are excited in the deep wells of the surface.

It is yet another object of this invention to provide a solid photocatalyst which is comprised of microarchitectured surface that has a substrate and a plurality of deep wells etched on the substrate.

It is yet another object of this invention to provide a method of selectively tuning electromagnetic energy utilizing a microarchitectured deep well surface wherein high energy standing waves are excited in the wells of the surface.

These and other objects are attained through use of the deep wells microarchitectured surface disclosed in this application and will be recognized by those with ordinary skill in the art.

Figure 1:
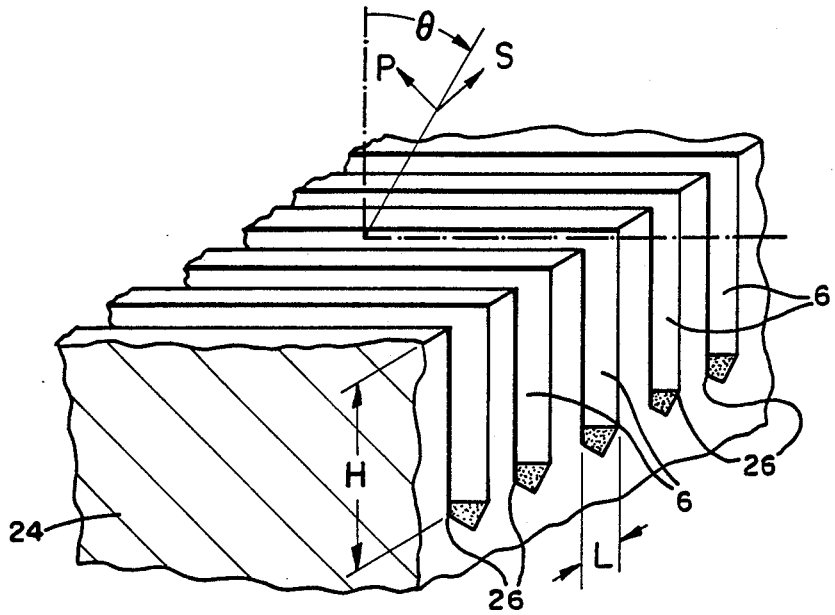
FIG. 1 is an illustration of a microarchitectured deep well surface.

Referring to FIG. 1, a microarchitectured or micromachined grating is shown generally at 24. The grating 24 is constructed, as known by those with ordinary skill in the art, with standard machining or photolithography techniques. In preferred embodiments, the grating is etched to the depth H, such as in a 40% solution of KOH at 50° C. with a suitable photoresist.

The photolithographic technique preferably etches deep, nearly square, wave gratings. The repeat distance Λ is understood by persons with ordinary skill in the art to be the distance from the start of one near square grating 26 to the start of the next near square grating. The length L, of the individual wells is shown. The term "deep" as applied to deep near square wave gratings is intended to mean near square wave gratings when Λ is comparable or less than λ, where λ is the wavelength of the electromagnetic radiation emitted from the deep, near square wave grating.

Figure 2:
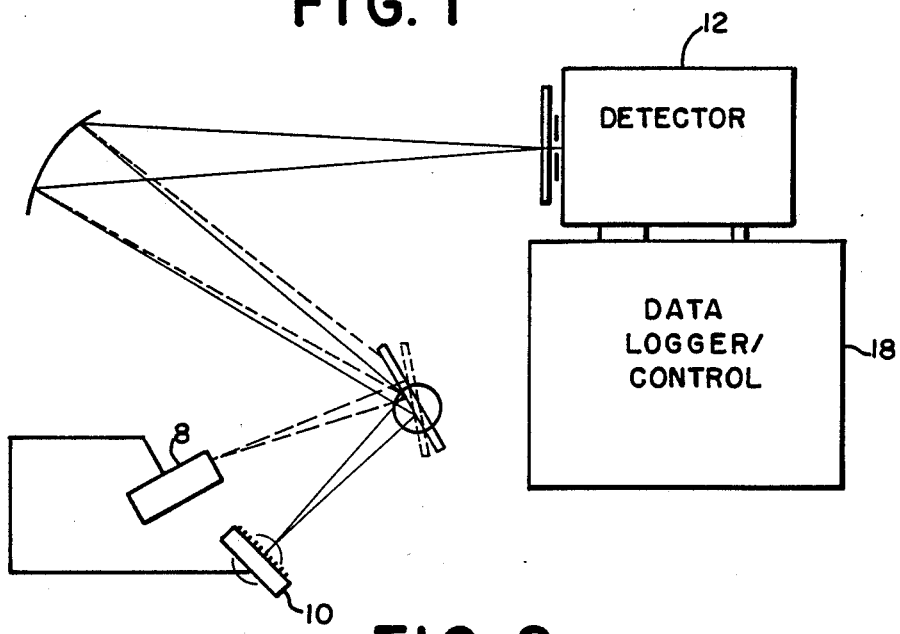
FIG. 2 is a blockram illustrating geometrical generation of quantum states with a microarchitectured surface.

Initial investigations of deep, near square wave gratings were done by the inventor who examined the blackbody radiation from such gratings. See J. Zemel, et al. 324 Nature No. 6097, p. 549–551 (Dec. 11, 1986) incorporated herein by reference. The inventor's investigation of the blackbody spectrum emitted from a deep, near wave square grating was conducted with oriented silicon wafers on which deep, near square gratings were etched to a common depth of approximately 45 micrometers. Referring to FIG. 2, blackbody source 8 is constructed, in preferred embodiments, from a copper cylinder. The temperature of blackbody source 8 is preferably kept at approximately 400° C. and controlled to better than 0.01° C. Blackbody source 8 is used as a reference for stabilizing the silicon sample's 10 temperature. A detector 12 preferably an infrared spectrophotometer is provided which preferably has a signal to noise ratio in excess of 100:1.

The measurement procedure comprises logging with detector 12, the polarized spectral intensity of the 400° C. blackbody 8 and silicon grating 10 both at normal incidence. This corresponds to a polar angle $\theta=0°$ and azimuthal angle $\phi=90°$. The polarized spectral emittance, $\epsilon(s,p;\lambda;T=400°\ C.)$ is defined as the ratio of the spectral intensities. For the above referenced angles, the s-polarization vector in FIG. 1 is parallel to the wells 6 and the p-polarization vector in FIG. 1 is perpendicular to the wells 6. Shifting $\phi$ to 0° reverses the definition of the s and p-polarization vectors relative to the wells 6 so they are perpendicular and parallel to the slots respectively. The data is logged with a digital data logger/-control component means, 18 in FIG. 2.

Figure 3A:
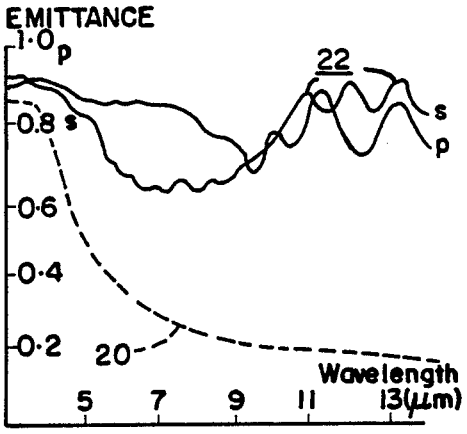
FIGS. 3*a*–3*d* shows Planckian resonance modes.
Figure 3B:
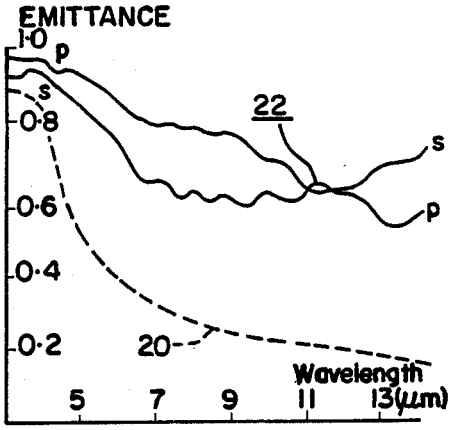
Figure 3C:
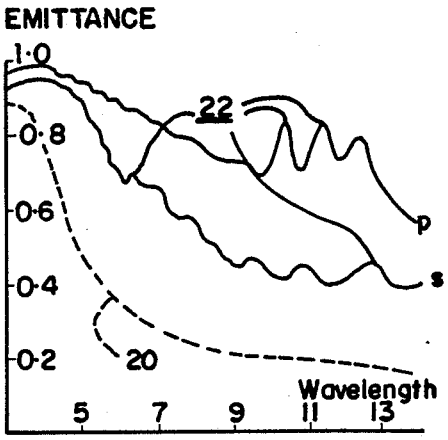
Figure 3D:
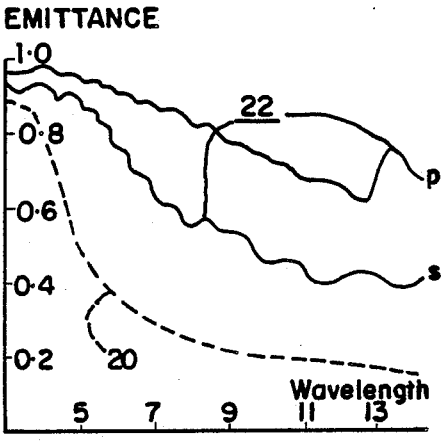

Referring to FIGS. 3*a*, 3*b*, 3*c*, and 3*d*, the spectral emittance as a function of spectral wavelength for the p and s-polarizations is shown. The gratings tested in FIGS. 3*a*, 3*b*, 3*c* and 3*d* had a depth H of 45 +/− 2 micrometers. The gratings tested in FIGS. 3*a*–3*d* were made from a standard lithographic technique. FIG. 3*a* had a repeat distance $\Lambda$ of 10 micrometers and grating length L of 7.3 micrometers; 3*b*, $\Lambda=14$ micrometers $L=8.4$ micrometers; 3*c*, $\Lambda 18$ micrometers $L=12.6$ micrometers; 3*d*, $\Lambda=22$ micrometers and $L=14$ micrometers. This yielded $\Lambda/\lambda$ ratios of between 0.14 to 7.33 since the wavelengths of the 400° C. blackbody infrared radiation was between 3 micrometers and 14 micrometers.

In FIGS. 3*a* through 3*d*, for the purposes of comparison, the value of the spectral emittance for a smooth, heavily doped silicon surface is shown as a dashed curve 20. The silicon surface preferably had a donor content of approximately $5\times10^{-19}$ cm$^{-3}$. The silicon surface had a repeat distance $\Lambda$ of approximately 45 $\mu$m and was etched using standard photolithographic techniques. Temperature had little influence on the magnitude of $\epsilon$ and essentially none on the period or amplitude of the observed oscillations. Pronounced periodic electromagnetic oscillations were found in both $E(\Delta;\lambda\neq T=400°\ C.)$ and $\epsilon(s;\lambda;T=400°\ C.)$ emitted from the gratings which had repeat distances, $\Lambda$, as shown in FIGS. 3*a* through 3*d* respectively. The oscillations are shown generally at 22. FIGS. 3*a*–3*d* show "organ pipe" or "Planckian" resonance modes shown at 22. The Planckian modes are distinct at the allowed wavelengths which shows that the states created within the wells are quantized.

Figure 4:
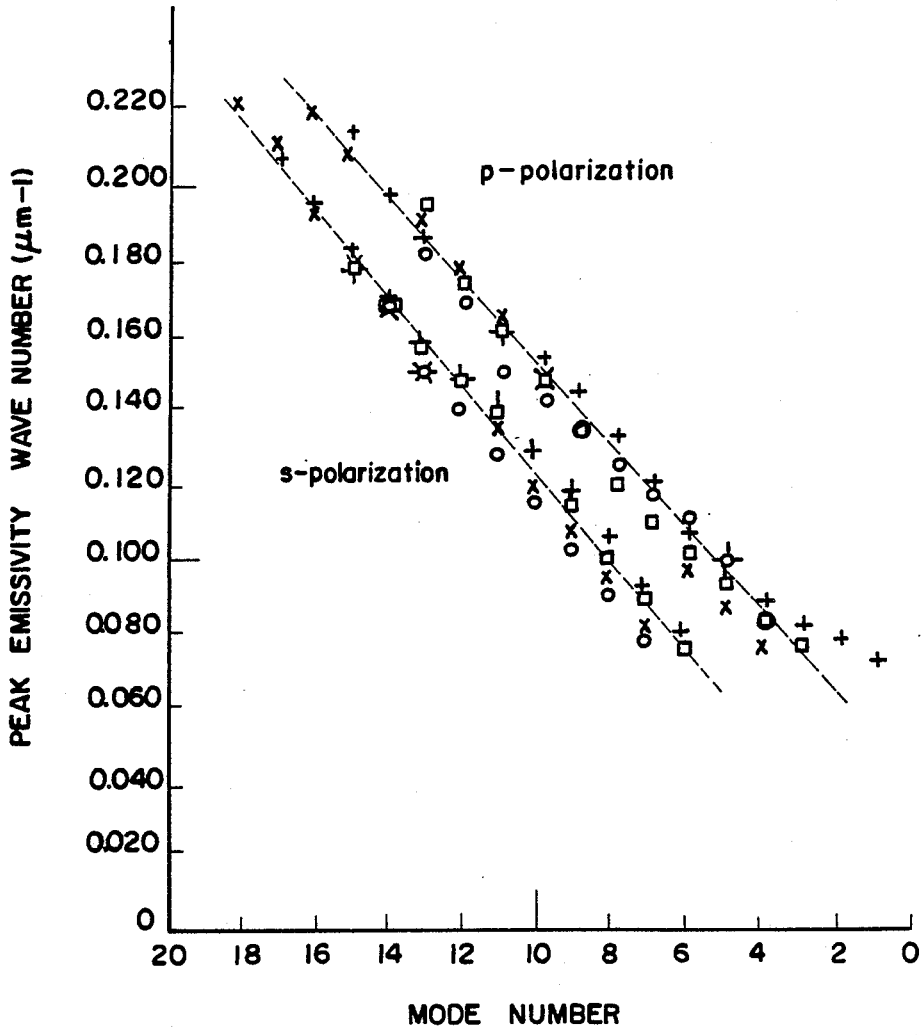
FIG. 4 illustrates the relation between the repeat distance, Λ, and the depth H, the wells such that Planckian modes are produced.

Referring to FIG. 4 the wave number, $K^{(i)}$, corresponding to maxima in the polarized spectral emittance ($K_m^{(i)}=1/\lambda_m^{(i)}$, i=s, p) were plotted against and integral mode number $m^{(i)}$ for the appropriate polarization, i=s, p. The origin of the $K_m^{(i)}$ plot for the individual gratings was adjusted preferably so that the data overlapped. There is no influence of $\Lambda$ on slope.

The peak emittance wave number versus mode number graph of FIG. 4 for p and s-polarizations was constructed from data from the four types of gratings examined in FIGS. 3*a*–3*d*. A mathematical model was constructed where preferably $K_m^{(i)}$ are related to $m^{(i)}$ by:

$$K^{(i)}m=m^{(i)}/2H$$

$$\text{or, } (2m^{(i)}+1)/4H$$

wherein the upper relation applies to modes where the nodes occur at 0 and H and the lower relation applies to when one node occurs at 0 and the anti-node is at H. In both cases, $$\Delta Km^{(i)}=\frac{\Delta m^{(i)}}{2H}$$

From FIG. 4 and the above equation it can be seen that, H=42 micrometers, which is in striking agreement with the average depth of approximately 45 micrometers measured in the four different gratings. This evinces extraordinary unexpected results as will be recognized by persons with ordinary skill in the art since $\Lambda$ varies by a factor of nearly two.

From FIG. 4 it can also be seen that the slope of $K_m^{(i)}m^{(i)}$ is independent of $\Lambda$. Inspection of the amplitudes of the emittance oscillations in FIGS. 3*a*–3*d* suggest that the p-polarized data oscillations are far more sensitive to $\Lambda$ than are the s-polarized which is yet another unexpected result. It is known that substantial field enhancement arises in the slots of a deep cavity for the s-polarizations electromagnetic energy. See, for example A. Hessel et al., A. A. Appl. Opt. 4, 1275–1297 (1965). However, the far field pattern associated with S-polarized radiative modes is weak and almost identical to those from a smooth mirror of similar composition. The peaks in the emittance are due to emissions from "organ pipe" or Planckian type resonance modes in the slots of the gratings. This is indeed an unexpected result and has heretofore not been demonstrated in deep well diffraction gratings. "Organ pipe" or Planckian resonance is known by those with ordinary skill in the art as electromagnetic standing waves analogous to acoustical standing waves created in a pipe with one closed end. Planckian resonance allows creation of new quantum states within the deep wells of the grating when energy is incident upon the grating. A quantum state is known by those with ordinary skill in the art as a state in which only discrete modes or frequencies are exhibited.

Since Planckian or "organ pipe" modes are available in a deep well of the microarchitectured surface, high energy fluxes are available within the microcavities of the microarchitectured surface.

Figure 5:
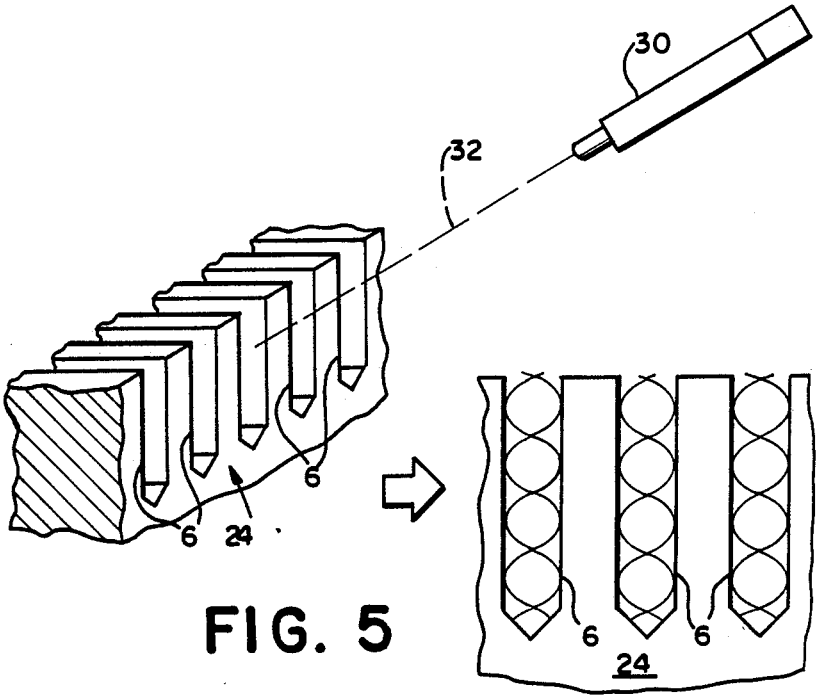
FIG. 5 is an illustration of generation of Planckian modes within a microarchitectured surface using electromagnetic radiation.
Figures 6A, 6B, 6C:
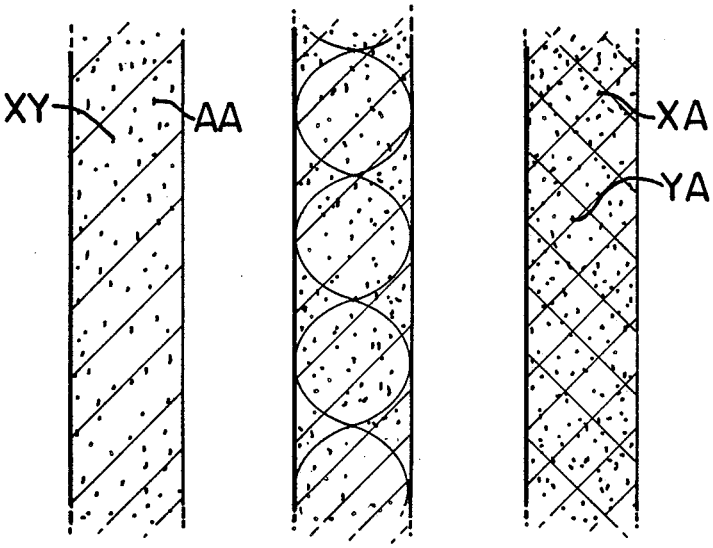
FIGS. 6*a*–6*c* illustrates production of new compounds with a solid photocatalyst.

Referring to FIG. 5, a method for stimulating Planckian resonance modes is illustrated. A coherent energy source, preferably a laser, 30 emits electromagnetic radiation 32 which incidents the surface of the deep well diffraction grating 24. Because the depth H, is selected to be comparable to the wavelength of the electromagnetic radiation 32, quantum states are excited within the wells, 6 of the grating 24. The quantum states are illustrated as standing wave patterns within the wells 6. The standing waves are bounded by the bottom of the wells and the top of the wells. It has now been found that high energy fluxes can be created within these wells through such excitation in accordance with this invention.

In this manner, extremely high energy fluxes are created within the wells 6 of the grating 24. This satisfies a long felt need in the art for high energy flux densities in extremely small areas which has heretofore not been attained. The wells 6 act as "energy flasks" which can be "filled" with electromagnetic standing waves of quantized frequencies. Useful applications exist for microarchitectured surfaces which produce such high energy quantized fluxes within the deep wells of the microcavities; others will flow from the knowledge that such fluxes can be had.

One application for the microarchitectured surface lies in the field of photochemistry. Previously, it has been nearly impossible to synthesize certain chemical compositions when the reaction has an extremely short rate constant. If, for example, a composition XY exists and it is desired to react the composition with another composition AA to produce XA and YA the rate constant corresponding to such reaction may be so small as to make the reaction unattainable in practice. If the reaction is photochemical in nature, mircroarchitectured surfaces in accordance with this invention may solve this problem and act as a "photocatalyst". The reaction can be written as:

$$XY = X_o + Y_o \xrightarrow{AA} XA + YA$$

If the overall rate constant is, for example, on the order $10^{-10}$/second under currently available photolytic combination, the process is commercially impractical. If the restraints can be subjected to fluxes $10^5$ to $10^8$ higher than presently available, the reaction could proceed at a useful rate. Such fluxes are available in the microarchitectured surfaces of the invention. In this manner, the microarchitectured surfaces with high energy Planckian modes in the deep wells becomes a "solid photocatalyst". A solid photocatalyst has heretofore not been known to those of ordinary skill in the art and satisfies a long felt need in the art in aiding production of physical reactions which have been impossible because of the extremely small rate constants involved.

Referring to FIGS. *6a–6c*, a method of photocatalyzing a compound with an extremely short rate constant is illustrated. A chemical compound, XY is diffused into a well. Simultaneously, a second chemical compound, AA is diffused into the well. This process is illustrated in FIG. *6a*. Because of the high energy flux density in the well, there is an extremely large increase in the photon density in the well as illustrated in FIG. *6b*. Therefore, compound XY absorbs the photons and is raised to an excited state capable of reacting with compound AA. The overall rate of the reaction is vastly improved. This allows the economical and efficient production of chemicals as shown in FIG. *6c* which previously was not possible. The microarchitectured surface thus satisfies a long felt need in the art for a solid photocatalyst to produce chemicals when small photochemical rate constants apply.

The microarchitectured deep well surface can greatly aid the chemist in conducting spectroscopic analysis. Spectroscopy, as understood by persons with ordinary skill in the art, is a technique whereby atoms or molecules of a substance are illuminated with a known wavelength of electromagnetic radiation to raise the atoms or molecules to excited states. When, for example, electrons are excited to high energy states, allowing such excited electrons to fall back to their lower state causes emittance of electromagnetic energy of a certain wavelength. By study and analysis of the emitted wavelengths a great deal of information can be determined about the substance. Spectroscopy is limited by the amount of energy available to stimulate the molecules and the wavelengths available from the energy source. A microarchitectured deep well surface can overcome this problem since it makes available extremely high energy fluxes which can be used to excite the atomic or molecular structure.

Since extremely high energy fluxes are available within the wells of the microarchitectured surface, new regimes in spectroscopy will be available. One of the advantages of the microarchitectured surface is that very little by-product heat is produced. This occurs since nearly all of the energy incident on the grating from the coherent source is contained in a quantized standing wave within the well. Therefore, the grating itself experiences very little thermal gain. In conventional spectroscopic techniques, the amount of energy which is used to excite the atoms or molecules is limited since heat build up is generally antithetical.

Figure 7:
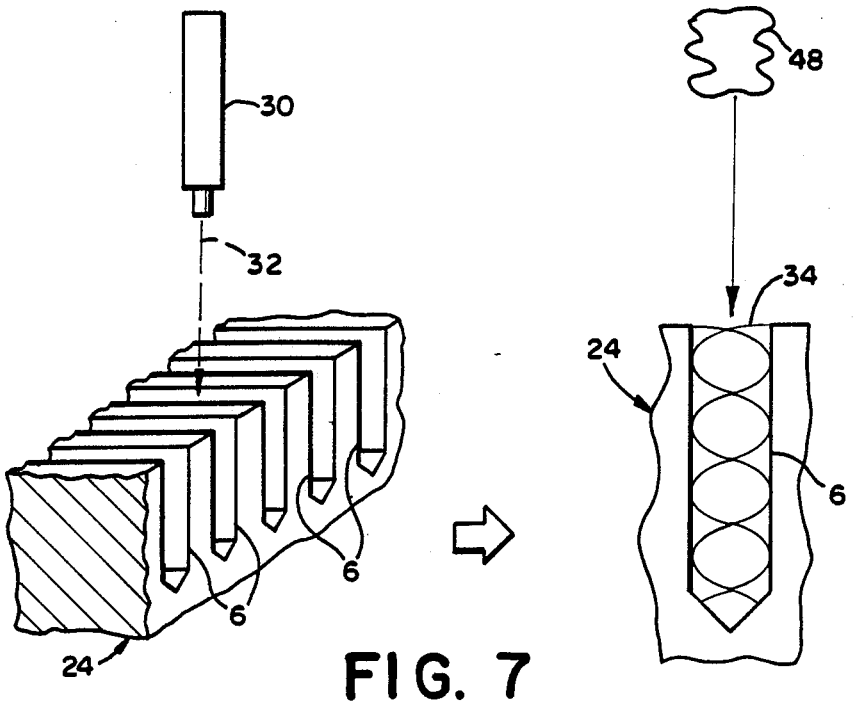
FIG. 7 illustrates a method of spectroscopy using the microarchitectured surface.

By constructing a spectrometer which utilizes microarchitectured deep well surfaces, in accordance with this invention, extremely high energy fluxes can be created to probe deeper into the nature of atoms and molecules with almost no by-product heat. Since very high energy photons exist within the well it is possible to excite electrons which are close to a nucleus into high energy levels. High energy photons are needed to excite electrons in electronic shells closer to the nucleus to higher levels since the electrons existing in these electronic shells are tightly bound. FIG. 7 sets forth a general scheme for such spectroscopy, a laser 30 illuminates microarchitectured surface 24. In a well 6 of microarchitectured surface 24 standing waves 34 are created. Electromagnetic radiation 32 is of preferably a high enough energy to excite the inner shell electrons of an atom or molecule shown generally at 48.

In preferred embodiments, compound 48 is in gaseous form. Chemical 48 is then diffused into well 6 where it interacts with standing wave 34 of high energy. The high energy photons of standing wave 34 excite the electrons in shells closer to the nucleus to higher energy levels. When these excited electrons fall back to the ground state, they emit radiation which is analyzed in conventional ways.

Since it has heretofore been impossible effectively to excite the inner electron levels of chemical 48, the information now available has not been previously available. The microarchitectured surface solves a long felt need for high energy spectroscopy since use of the microarchitectured surface 24 will permit the probing of the inner electron shells of a substance without deleterious generation of heat. This will allow realistic scientific experiment into the nature of the inner electronic structure of chemical species.

In further preferred embodiments, the microarchitectured surface functions as an "energy tuner". As used herein, an "energy tuner" is a device which can output a selected wavelength when the input is a different wavelength. This is possible with the microarchitectured surfaces of this invention since it has now been found electronic radiation emanating from the surface is dependent upon the angle at which it leaves the deep wells.

Figure 8:
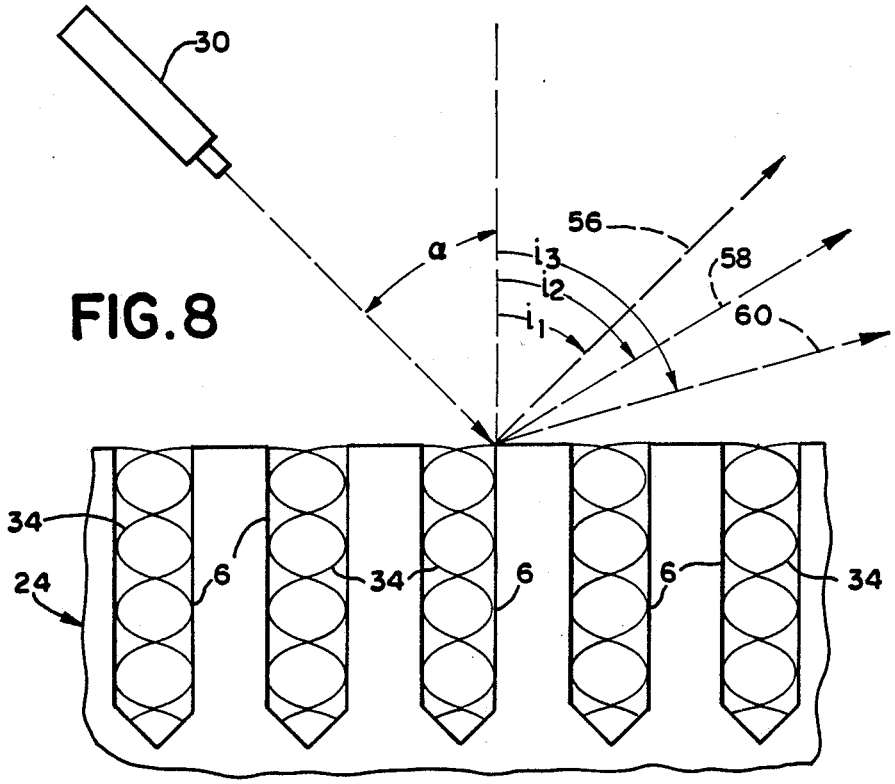
FIG. 8 illustrates a method of tuning energy using a microarchitectured surface.

Referring to FIG. 8, microarchitectured surface 24 is irradiated with electromagnetic radiation 32 from laser 30. The deep wells 6 contain standing waves of high energy flux density 34 produced by radiation 32. Radiation 32 is of discrete wavelength $\lambda$ and energy $h\nu$. Additionally, it is seen on FIG. 8 that radiation 32 is caused to impinge upon microarchitectured surface 24 at angle $\alpha$. When a microarchitectured deep well surface is irradiated, the deep wells 6 develop standing waves. Additionally, re-radiation from the wells occurs. The inventor has found that this re-radiation has a spectral content dependent upon the angle at which re-radiation occurs.

This spectral content occurs since the deep well microarchitectured surface geometrically generates quantum states. Therefore, re-radiation of quantized energy depends upon the angle of re-radiation achieved. Such a phenomenon has heretofore been unknown in the art and is an unexpected result based upon geometrical generation of quantum states within a deep well microarchitectured surface in accordance with this invention.

In FIG. 8, it can be seen that re-radiation of quantized states occurs at frequency $\nu_1$ and angle $i_1$. Similarly, frequencies $\nu_2$ and $\nu_3$ radiate respectfully at angles $i_2$ and $i_3$. The quantized re-radiated energies are a function of the depth of the wells 6, the wavelength of the incoming radiation and the angle at which the incoming radiation impinges upon microarchitectured surface 24.

The microarchitectured surface fulfills a long felt need in the art for a device which can output select quantized radiation. The microarchitectured surface, in preferred embodiments, acts as an energy tuner since quantized output radiation is produced which is a function of the input radiation and the angles of incidence. Numerous uses exist for energy tuners in accordance with this aspect of the invention as will be recognized by persons of ordinary skill in the art. Such uses include, but are not limited to, chemical spectroscopy, coherent generation of quantized radiation and photochemical analysis.

Microarchitectured deep well surfaces have been described. Additionally, applications and uses of the microarchitectured deep well surfaces have been described. While preferred embodiments have herein been disclosed, it will be recognized by persons with ordinary skill in the art that various modifications are within the true spirit and scope of the invention. Therefore, the description the appended claims are intended to cover all such modifications.

What is claimed:

1. A method of stimulating quantum states in a microarchitectured surface comprising:

providing a microarchitectured surface, said surface having a plurality of wells having depths greater than or equal to 45 micrometers, said wells having lengths at least about two times less than said depths and uniform repeat distances on the order of said depths, illuminating said surface with radiation, and allowing quantized standing waves to be formed in said wells of said microarchitectured surface.

2. A method of stimulating quantum states in a microarchitectured surface as recited in claim 1 wherein said radiation emanates from a laser.

* * * * *

UNITED STATES PATENT AND TRADEMARK OFFICE

CERTIFICATE OF CORRECTION

PATENT NO. : 4,899,058

DATED : February 6, 1990

INVENTOR(S) : Jay N. Zemel

It is certified that error appears in the above-identified patent and that said Letters Patent is hereby corrected as shown below:

| | |
|---|---|
| Col. 4, line 4 | The word "a" should be deleted |
| Col. 5, line 45 | The last symbol of the line should be --Δ--, according to the application |
| Col. 9, line 18 | Respectfully should be --respectively-- |

Signed and Sealed this

Fourteenth Day of May, 1991

*Attest:*

HARRY F. MANBECK, JR.

*Attesting Officer*

*Commissioner of Patents and Trademarks*